US006735796B2

(12) United States Patent
Warner, Jr. et al.

(10) Patent No.: US 6,735,796 B2
(45) **Date of Patent: *May 18, 2004**

(54) COMBINATION FOLDING PLAY PEN WITH CHANGING TABLE AND BASSINET

(75) Inventors: Robert J. Warner, Jr., Akron, OH (US); Richard Essex, New Royalton, OH (US)

(73) Assignee: Graco Children's Products Inc., Exton, PA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/764,090

(22) Filed: Jan. 19, 2001

(65) Prior Publication Data

US 2001/0001161 A1 May 17, 2001

Related U.S. Application Data

(63) Continuation of application No. 09/085,690, filed on May 27, 1998.

(51) Int. Cl.[7] ..... A47D 7/00
(52) U.S. Cl. ..... 5/99.1; 5/93.1; 5/93.2
(58) Field of Search ..... 403/353, 205, 403/403, 382; 5/93.1, 98.1, 99.1, 93.2

(56) References Cited

U.S. PATENT DOCUMENTS

| | | | | |
|---|---|---|---|---|
| 3,146,736 A | | 9/1964 | Hetrick | |
| 4,021,127 A | | 5/1977 | Gasparro et al. | |
| 4,073,017 A | | 2/1978 | Stevens | |
| 4,473,316 A | | 9/1984 | Welch | |
| 4,967,432 A | | 11/1990 | Kujawski et al. | |
| 5,025,517 A | | 6/1991 | Johnson | |
| 5,339,470 A | | 8/1994 | Shamie | |
| 5,349,709 A | | 9/1994 | Cheng | |
| 5,553,336 A | | 9/1996 | Mariol | |
| 5,615,427 A | | 4/1997 | Huang | |
| 5,778,465 A | | 7/1998 | Meyers | |
| 5,918,329 A | * | 7/1999 | Huang | 5/93.1 |
| 5,991,944 A | | 11/1999 | Yang | |
| 6,233,759 B1 | * | 5/2001 | Warner et al. | |

FOREIGN PATENT DOCUMENTS

| | | |
|---|---|---|
| EP | 534 215 A1 | 3/1993 |
| FR | 2 550 929 | 3/1985 |
| GB | 2 152 813 A | 8/1985 |

OTHER PUBLICATIONS

Century Playard with Bassinet/Changer Instruction Manual, "Fold–$^{n}$–Go™ Care Center" (1/98).

* cited by examiner

*Primary Examiner*—Teri Pham Luu
*Assistant Examiner*—Fredrick Conley
(74) *Attorney, Agent, or Firm*—Foley & Lardner

(57) ABSTRACT

A combination play pen, bassinet and changing table includes a bassinet assembly removably supported on the upper frame assembly of the play pen. The bassinet assembly includes a pair of bassinet frame assemblies, each consisting of a pair of J-tube assemblies joined by a cross tube. The J-tube assemblies include outer ends adapted to overly the upper frame. Bassinet side panels and end panels extend upwardly from the floor panel to form a coffer-like enclosure. An adapter supports the J end of the bassinet tube that overlies a collapsible joint assembly at the midpoint of one upper rail assembly. A changing table assembly includes a tubular frame comprised of paired side tubes and end tubes joined in a rectangular configuration. Two vertices of the changing table frame are adjacent to the adapters of the bassinet assembly. A keyed elbow connector at each vertex includes a T-shaped key received in a key slot of an adapter in supporting fashion. The changing table frame includes a pair of second elbow connectors, each including a pair of lugs projecting therefrom. Each second elbow connector impinges on the web of the adjacent upper corner bracket in supported relationship, and the lugs are received in the concave pocket of the web to retain the vertex of the changing table frame in the upper corner of the play pen frame assembly.

35 Claims, 7 Drawing Sheets

COMBINATION FOLDING PLAY PEN WITH CHANGING TABLE AND BASSINET

This application is a continuation of application Ser. No. 09/085,690, filed May 27, 1998.

BACKGROUND OF THE INVENTION

This invention generally relates to a collapsible play yard or play pen apparatus, and more particularly to an improved play pen that may be converted to accomplish other baby caretaking functions. One exemplary apparatus in the prior art is described in U.S. Pat. No. 5,381,570 to Cheng, which is incorporated herein by reference in its entirety.

Folding play pens are well known in the prior art and comprise a standard item in parenting and baby caretaking. A play pen enables a baby or toddler to play within a controlled and protected space without requiring continual attention by a responsible adult. Such play pens can be folded into a small space for easy storage and transport and are therefore convenient items for use in high mobility situations.

However, the standard play pen does not address other baby caretaking functions, such as the continual need for changing diapers and dressing, and the need to provide adequate nap space for the child. As a result, parents or caretakers in mobility situations must transport other portable baby furniture, or must improvise these functions with whatever furniture is found at hand. For example, the changing and dressing function may be accomplished on top of an adult bed or table, or on a bathroom sink countertop. These improvisations are fraught with unknown and unseen perils for the child, such as exposure to falling hazards, soaps and chemicals, electrical hazards, and the like. In addition, the frequent naps which small children require are often taken on the floor of the play pen, which is not designed for comfort in such use. Moreover, many small children sleep best in a smaller, cozier space, which the standard play pen does not provide.

There are known in the prior art various forms of play pens that may be combined with a removable bassinet structure. These structures generally are suspended over the upper opening of the play pen and fill the entire opening. A bassinet of such size may be unsuitable for newborn and infant use, due to the fact that a smaller, cozier sleeping space is preferred for such young children. Moreover, the large prior art bassinet structures do not allow any opportunity to provide a changing table in addition to the bassinet itself.

The choice for many traveling parents or caretakers often is to transport a portable play pen, portable changing table or pad, and folding bed or the like for naps. This is a daunting logistical problem, and a discouragement for many parents who would otherwise wish to have greater mobility. Clearly there is a need in the prior art for meeting these disparate apparatus requirements in a more compact, transportable form.

SUMMARY OF THE INVENTION

The invention generally comprises an improved play pen or play yard apparatus. A significant feature of the invention is that it is easily converted to use as a baby bassinet and a changing table, whereby it may be used to carry out many of the typical baby caretaking functions.

A typical play pen collapsible frame structure generally includes an upper frame assembly comprised of two pair of parallel collapsible rail assemblies which are supported by corner leg assemblies. The rail assemblies support the side panels of the play pen, while a lower frame assembly is secured to the leg assemblies to support the floor portion of the apparatus. The particular construction of these frame assemblies does not form part of the invention, except for the components described hereinafter.

At each corner of the upper frame assembly, the invention provides an upper corner bracket, each upper corner bracket including diverging body portions extending in orthogonal relationship and adapted to engage a respective collapsible rail assembly. A web extends across the included angle between the diverging body portions, and a concave pocket is formed in the top surface of the arcuate web.

In one aspect of the invention, there is provided a bassinet assembly that is removably supported on a portion of the upper frame assembly. The bassinet assembly includes a pair of bassinet frame assemblies, each consisting of a pair of J-tube assemblies joined by a cross tube. The J-tube assemblies include outer ends that are adapted to overly the upper rail assemblies and be suspended therefrom. The bassinet floor panel is disposed below the upper rail assembly and above the floor of the play pen, and is supported on the cross tubes. Bassinet side panels and end panels of soft fabric extend upwardly from the bassinet floor panel to form a coffer-like enclosure that is sufficiently small and cozy for the resting and napping functions of a bassinet. Sleeves formed in the end panels and floor panel secure portions of the cross tubes and J-tube assemblies.

Regarding the pair of J-tube assemblies that comprise each bassinet frame assembly, one outer J end overlies a respective upper corner bracket. The other outer J end is secured in a hub adapter that supports the J end of the bassinet tube, the hub adapter being configured to rest on and be supported by a collapsible joint assembly located generally at the midpoint of a respective upper rail assembly of the playpen frame structure. Thus the bassinet assembly is supported entirely by suspension from the upper frame portion of the playpen, and may be installed and removed as a single unit. The bassinet assembly is also readily disassembled and collapsed for easy transport.

In another aspect of the invention, there is provided a changing table assembly that is removably supported on a portion of the upper frame assembly adjacent to the bassinet assembly. The changing table assembly includes a tubular frame comprised of paired side tubes and paired end tubes joined in a rectangular configuration. Two vertices of the rectangular changing table frame are disposed adjacent to the hub adapters of the bassinet assembly. The changing table frame includes a pair of first elbow connectors, each disposed at a respective vertex of the rectangular frame and adapted to join a side tube and end tube in orthogonal relationship. Each first elbow connector further includes a T-shaped key extending outwardly therefrom, and each hub adapter is provides with a key slot to receive the key of the adjacent first elbow connector, whereby the hub adapter of the bassinet assembly supports the adjacent vertex of the changing table frame.

The changing table frame further includes a pair of second elbow connectors, each disposed adjacent to one upper corner bracket of the play pen and adapted to join a side tube and end tube in orthogonal relationship. Each second elbow connector includes a pair of lugs projecting therefrom in opposed fashion along an axis generally transverse to the changing table frame. Each second elbow connector is disposed to impinge on the web of the adjacent upper corner bracket in supported relationship, and the lugs are each configured to be received in the concave pocket of the web to locate and retain the vertex of the changing table frame with respect to the upper corner of the play pen frame assembly. Thus the changing table frame is supported at two corners by the upper corner brackets of the play pen frame assembly and at the other two corners by the adjacent hub adapters of the bassinet assembly.

The changing table assembly further includes a horizontal table panel joined to fabric side panels and end panels, which in turn are provided with sleeves to engage the changing table frame in suspended relationship. The table panel is supported slightly below the upper frame assembly of the play pen, and significantly higher than the floor of the bassinet assembly. The table panel provides a changing and dressing surface at a height convenient for those purposes. Due to the fact that changing and dressing often occurs before and after napping, which takes place in the bassinet, the changing table is placed in the most convenient possible location. And, like the bassinet assembly, the changing table assembly may be removed as a unit from its supported position on the play pen, and may be readily disassembled and collapsed for easy transport. When both the bassinet assembly and changing table assembly are removed, the upper opening of the play pen is unobstructed and the play pen is available for the purpose of permitting a baby or toddler to play within its controlled and protected interior space.

DESCRIPTION OF THE PREFERRED EMBODIMENT

The invention generally comprises an improved play pen or play yard apparatus. A significant feature of the invention is that it is easily converted to use as a baby bassinet and a changing table, thereby making more efficient use of space and apparatus.

Figure 1:
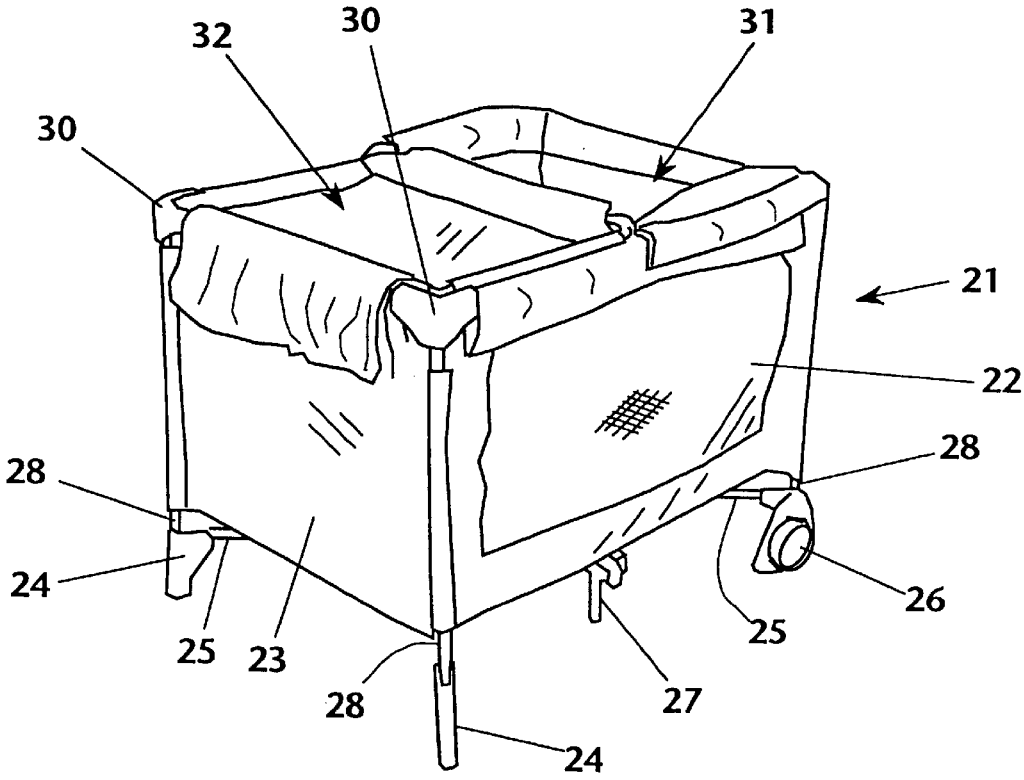
FIG. 1 is a perspective view of the combination play pen with bassinet and changing table in accordance with the present invention.

With regard to FIG. 1, a typical collapsible, portable play pen 21 includes a pair of fabric and mesh side panels 22 joined to a pair of fabric (or mesh) end panels 23 to form a rectangular enclosure. A floor panel (not shown) spans the lower edges of the side and end panels, and is supported by a lower frame structure. The lower frame structure may include legs 24 and/or wheels 26 joined to lateral struts 25. A quartet of vertical struts 28 extend upwardly through panel sleeves from the lower frame structure at the corners of the apparatus, and are joined to a quartet of upper corner brackets 30. This generically described play pen defines a coffer-like configuration having upper opening.

The present invention provides a bassinet assembly 31 and a changing table assembly 32 that may be supported on the upper frame assembly of the play pen 21 and disposed to span the upper opening thereof. Both assemblies 31 and 32 are independent units that are easily installed and removed from the play pen, whereby the structure may be adapted for baby naps and baby changing and dressing functions. Thus the combined structures comprise a complete infant care center that is optimally efficient in use of space, apparatus, and resources.

Figure 2:
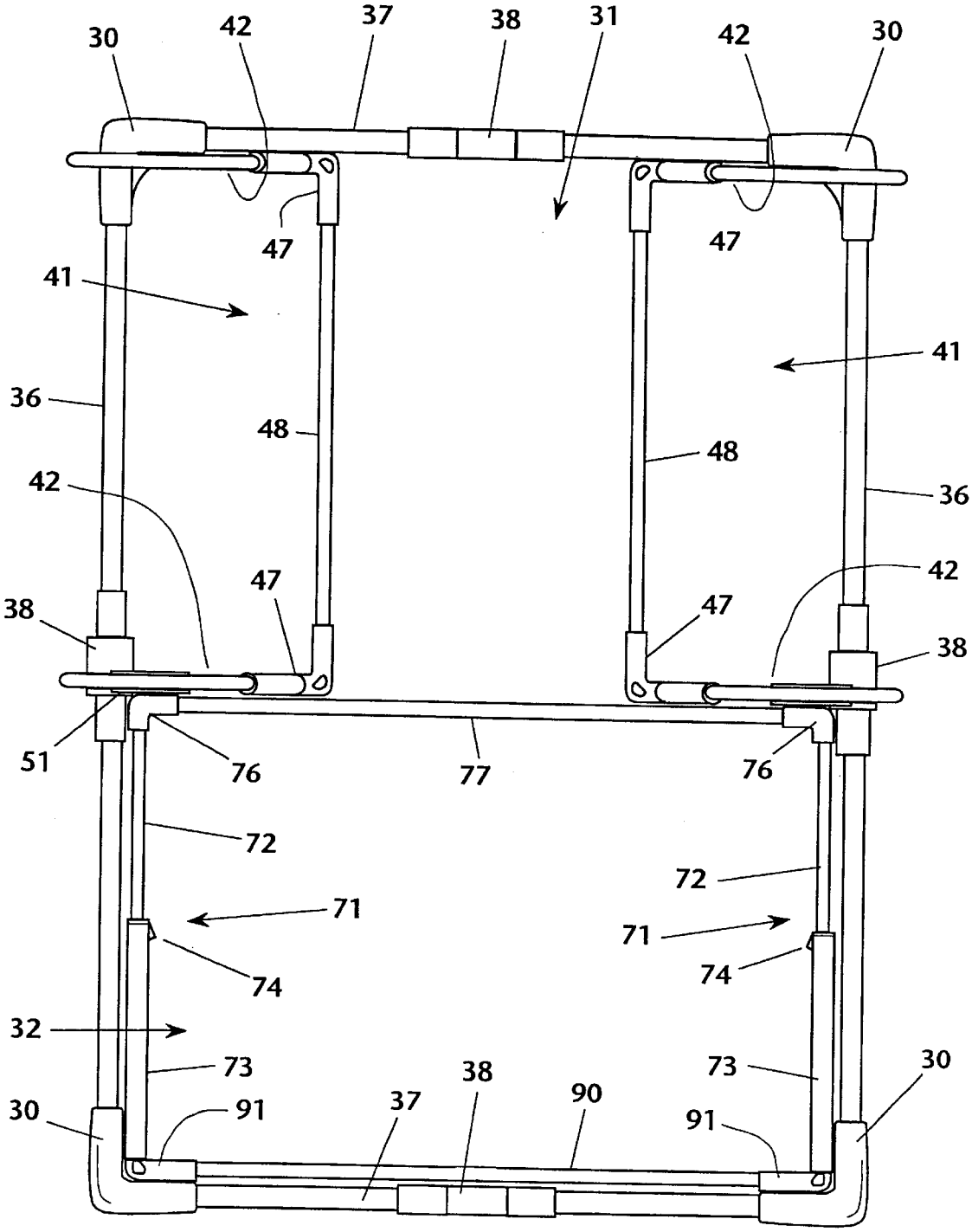
FIG. 2 is a plan view of the upper frame assembly of the play pen, together with the bassinet frame assembly and the changing table assembly.
Figure 3:
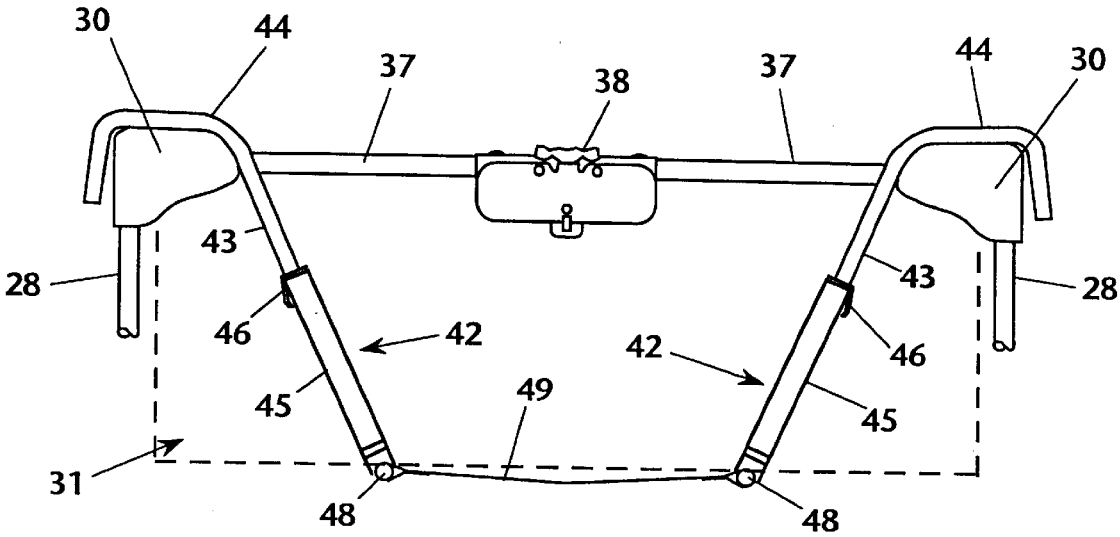
FIG. 3 is a partial end elevation showing the engagement of the bassinet frame assembly with the corner brackets of the upper frame assembly of the play pen.

With regard to FIG. 2, the upper frame assembly of the play pen 21 generally includes the upper corner brackets 30 which join upper frame side rail assemblies 36 with upper frame end rail assemblies 37. The assemblies 36 and 37 are each provided with hinges 38 at mid-span that are selectively locked or rotatable to allow the upper frame assembly to be rigid or collapsed. With additional reference to FIGS. 3 and 4, the bassinet assembly 31 includes a pair of bassinet frame assemblies 41. Each assembly 41 includes a pair of J-tube assemblies 42, consisting of a J-tube 43 having an upper hook end 44 and a linear tubular portion depending therefrom and received in telescoping fashion in a bushing 45. A spring detent assembly 46 secured to the bushing 45 permits length adjustment and rotation of the telescoping engagement of the J-tube and bushing.

An elbow 47 is secured to the lower end of each bushing 45, and oriented to secure a crosstube 48 in a horizontal disposition between each pair of assemblies 42. Sleeves sewn on the bassinet sides and floor join the pair of bassinet frame assemblies 41. With the J hook ends 44 hanging on the upper frame rail assemblies, the assemblies 42 depend into the upper opening of the play pen 21. The crosstubes 48, the sewn sleeves on the bassinet sides and the sewn sides and floor of the bassinet form a stable horizontal base for the floor of the bassinet, and side panels and end panels of soft fabric extend upwardly from the bassinet floor panel to form a coffer-like enclosure that is sufficiently small and cozy for the resting and napping functions of a bassinet.

One J-tube assembly 42 of each frame assembly 41 is disposed adjacent to a respective upper corner bracket 30, and the J-hook portion 44 thereof rests thereon in a supported relationship. The other end of the J-tube assembly 42 is disposed so that the J-hook end 44 thereof passes over the hinge 38 of the upper rail assembly 36, and is supported thereby. Thus the bassinet assembly is supported entirely by suspension from the upper frame portion of the playpen, and may be installed and removed as a single unit. The bassinet assembly is also readily disassembled and collapsed for easy transport.

Figure 8:
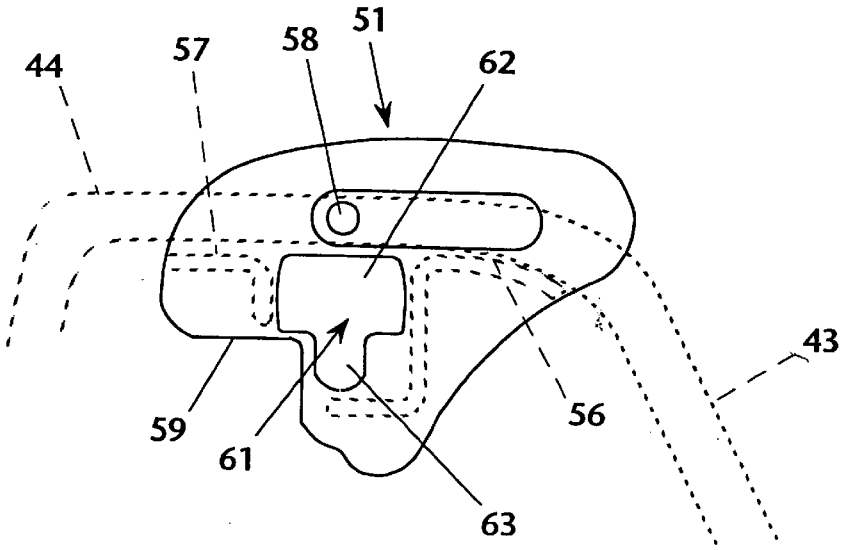
FIG. 8 is a side elevation of a hub adapter assembly constructed in accordance with the present invention.
Figure 9:
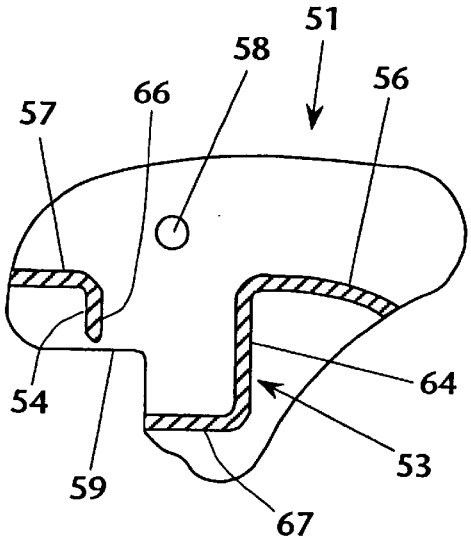
FIG. 9 is a cross-section elevation of the hub adapter shown in FIG. 8.
Figure 10:
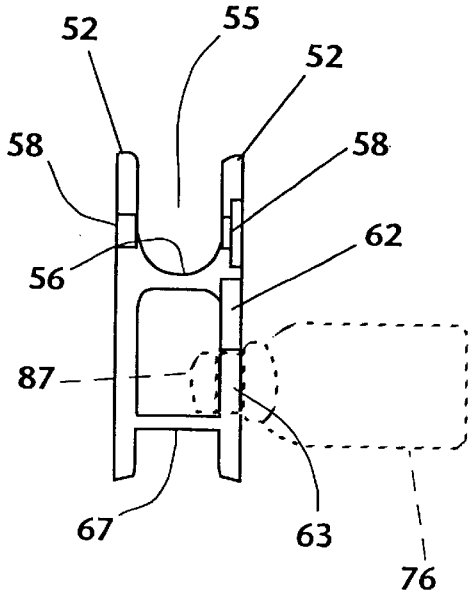
FIG. 10 is an end elevation of the hub adapter shown in FIGS. 8 and 9.

The invention provides an adapter 51 which functions in part to secure the J-hook portion 44 to the hinge 38. With reference to FIGS. 8–10, the adapter 51 includes a pair of sidewalls 52 disposed in parallel, spaced apart fashion, and transverse web portions 53 and 54 extending between the sidewalls. The sidewalls 52 define therebetween a channel 55 having a width dimension sufficient to receive the J-hook end 44 therein in a minimal clearance fit. Upper portions 56 of web 53 and upper portion 57 of web 54 form the floor of the channel 55 upon which the J-hook end 44 may be supported. Aligned holes 58 extend through the sidewalls to receive a fastener such as a screw and nut assembly (not shown) that anchors the adapter 51 to the J-hook end 44. The outer perimetrical surface of the sidewalls is generally smoothly curved in convex fashion, except for a lower rectangular inset portion 59 that is configured to rest on the hinge 38 in a stable engagement.

Each adapter 51 further includes a keyhole 61 extending into one sidewall 52. The keyhole 61 includes a wide, generally rectangular upper portion 62 and a narrow slot portion 63 centered at the lower edge of the upper portion. The keyhole 61 is spaced laterally between the web portions 64 and 66 and vertically above the web portion 67. The purpose of the keyhole is clarified in the following description.

Figure 4:
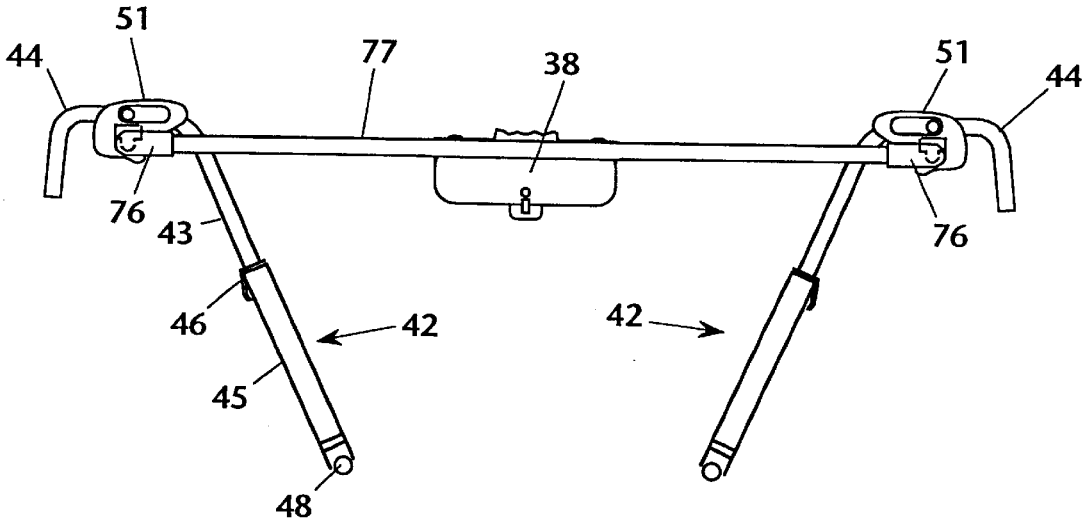
FIG. 4 is a partial end elevation showing the engagement of the bassinet frame assembly with a portion of the changing table frame assembly.
Figure 5:
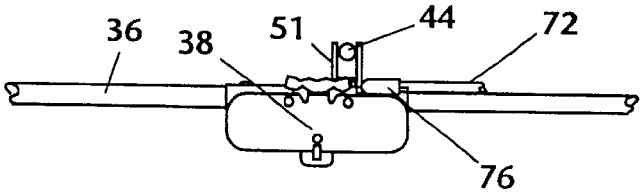
FIG. 5 is a partial side elevation depicting the engagement of the hub adapter and changing table frame assembly with the upper frame assembly of the play pen.

With reference to FIGS. 2 and 4, the changing table assembly 32 includes a tubular rectangular frame that supports a changing panel at a height equal to or slightly below the upper frame assembly of the play pen. The rectangular frame includes a pair of extendable assemblies 71, comprised of a tube 72 received in telescoping fashion in a larger tube 73. A spring detent assembly 74 permits selective length adjustment of the assembly 71. The outer end of each tube 72 is joined to a keyed elbow connector 76, and a lateral tube 77 is joined to the keyed elbow connectors 76 to span the sides of the play pen 21.

Figure 11:
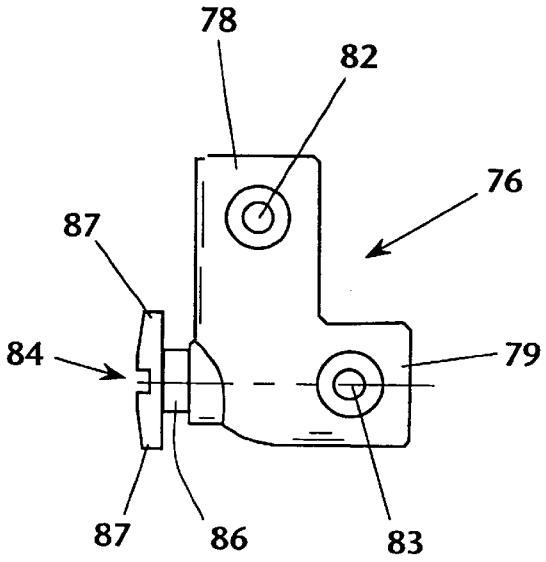
FIG. 11 is a plan view of the first elbow connector of the changing table frame assembly of the invention.
Figure 12:
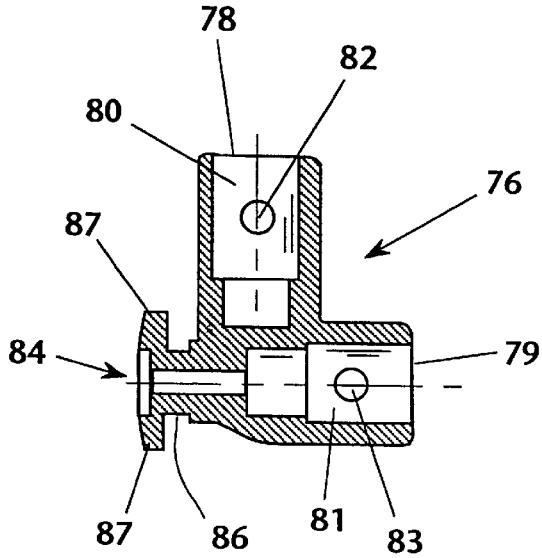
FIG. 12 is a cross-sectional plan view of the first elbow connector as shown in FIG. 11.
Figure 13:
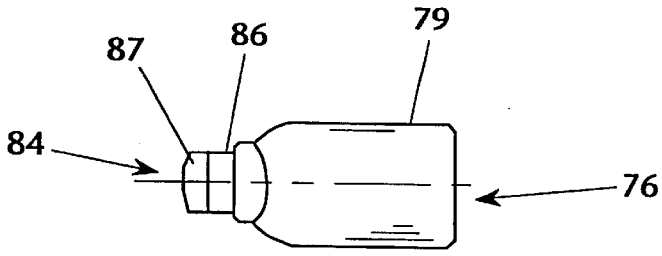
FIG. 13 is an end view of the first elbow connector shown in FIGS. 11 and 12.
Figure 14:
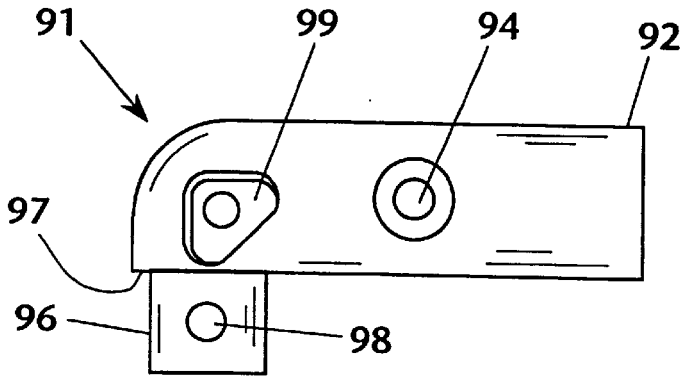
FIG. 14 is a plan view of the second elbow connector of the changing table frame assembly of the invention.
Figure 15:
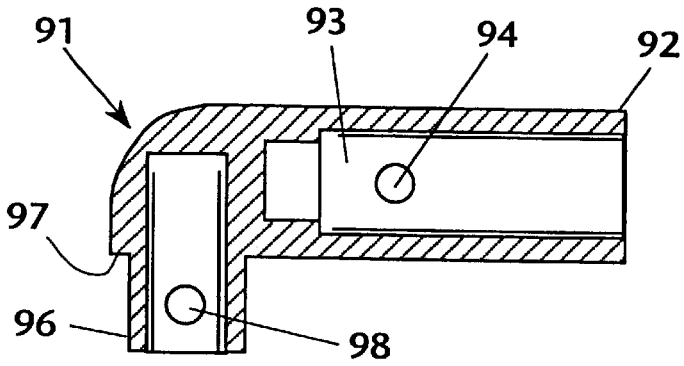
FIG. 15 is a cross-sectional plan view of the second elbow connector shown in FIG. 14.
Figure 17:
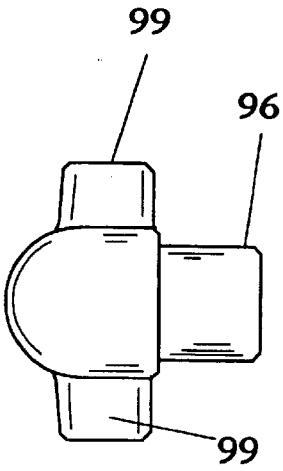
FIG. 17 is an end view of the second elbow connector shown in FIGS. 14–16.
Figure 16:
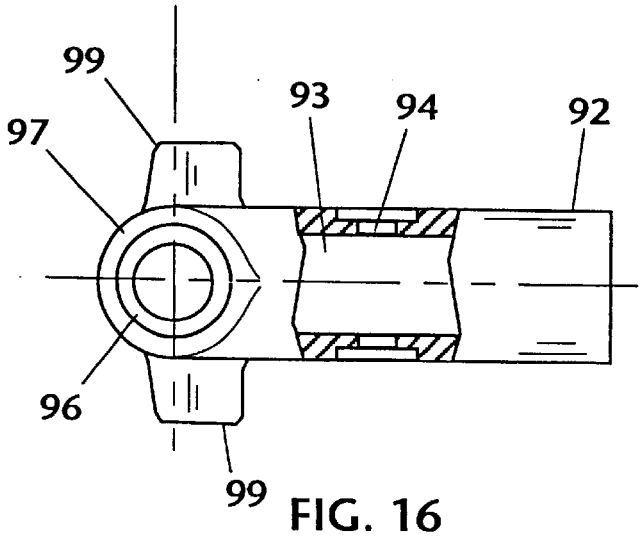
FIG. 16 is a partially broken away side elevation of the second elbow connector shown in FIGS. 14 and 15.

With reference to FIGS. 11–13, each keyed elbow connector 76 is comprised of tubular body portions 78 and 79 joined in orthogonal relationship. Cylindrical receptacles 80 and 81 are formed concentrically in respective body portions 78 and 79. Receptacle 80 is dimensioned to receive therein lateral tube 77, and receptacle 81 is dimensioned to receive telescoping tube 72. Screw holes 82 and 83 accommodate fasteners to retain the tubes in their respective receptacles. A T-shaped key 84 extends from the elbow, the key 84 including a narrow stem 86 extending generally coaxially with the receptacle 81. Outer flanges 87 extend from the stem 86 and are aligned generally parallel to the axis of receptacle 80.

The flanges 87 are slightly narrower than the width of portion 62 of keyhole 61 (FIG. 8), so that the flanges 87 may be inserted into the portion 62. The width of slot 63 of the keyhole is greater than the diameter of stem 86 of the key 84, but the slot 63 is significantly narrower than the width of the flanges 87. As a result of these dimensional relationships, the key 84 may be inserted into opening 62 and the stem may be urged into slot 63, whereby the key 84 is lodged in the keyhole 61 (FIG. 10). This releasable engagement serves to support the elbow connectors 76 on the hub adapters 51, and thus to support two corners of the tubular rectangular frame of the changing table assembly.

Returning to FIG. 2, each tube 73 is joined to an elbow connector 91, and a lateral tube 90 is joined to the keyed elbow connectors 91 to span the sides of the play pen 21. With reference to FIGS. 14–17, each elbow connector 91 includes a tubular body 92 having a coaxial receptacle 93 formed therein and dimensioned to accept the lateral tube 90. Aligned screw holes 94 are disposed to receive appropriate fasteners to retain the tube 90 in the receptacle 93. A cylindrical anchor 96 extends from one end of the body 92, and is disposed concentrically within an annular flat 97. The anchor 96 has an outer diameter dimensioned to be received within tube 73, and a screw hole 98 accepts a fastener to secure the tube 73 about the anchor 96.

A salient feature of the elbow connector 91 is the provision of a pair of posts 99 extending therefrom in opposed relationship. The posts 99 are aligned along an axis extending orthogonally to both the axis of the tubular body 92 and the axis of the cylindrical anchor 96. As shown best in FIG. 14, each post 99 is configured as a triangular prism, for purposes detailed in the following description. The posts 99 are disposed at the end of the tubular body 92 and are generally adjacent to the anchor 96.

Figure 6:
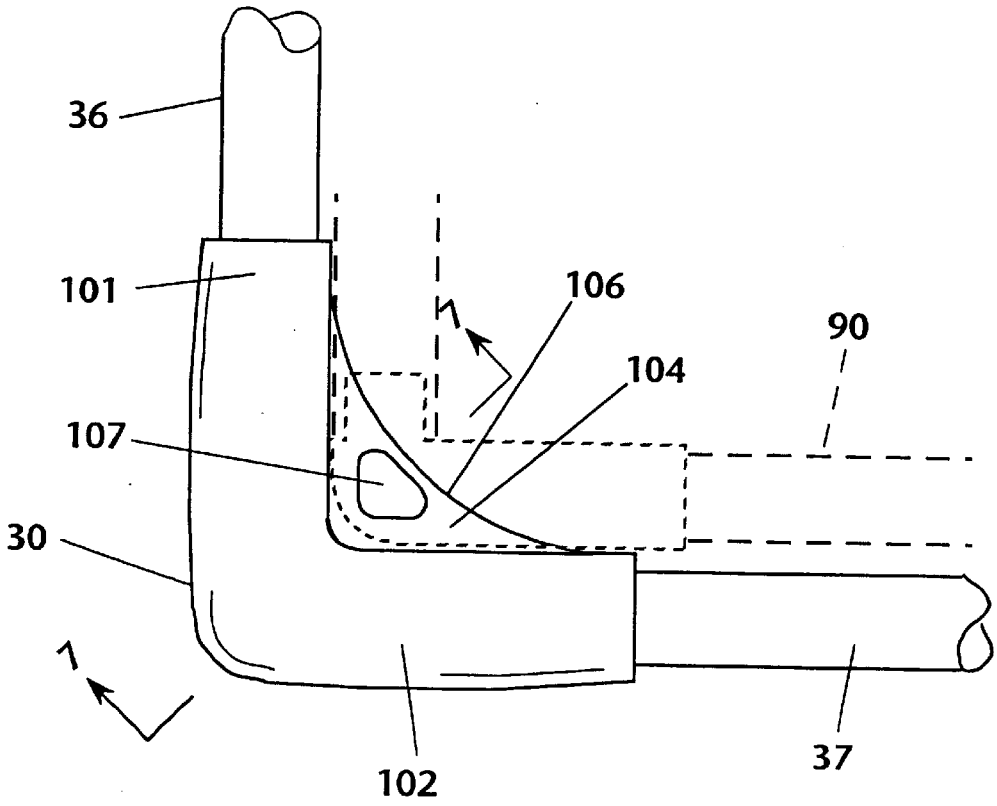
FIG. 6 is an enlarged plan view of the upper corner bracket assembly of the play pen, showing the relationship thereto of the changing table frame assembly.
Figure 7:
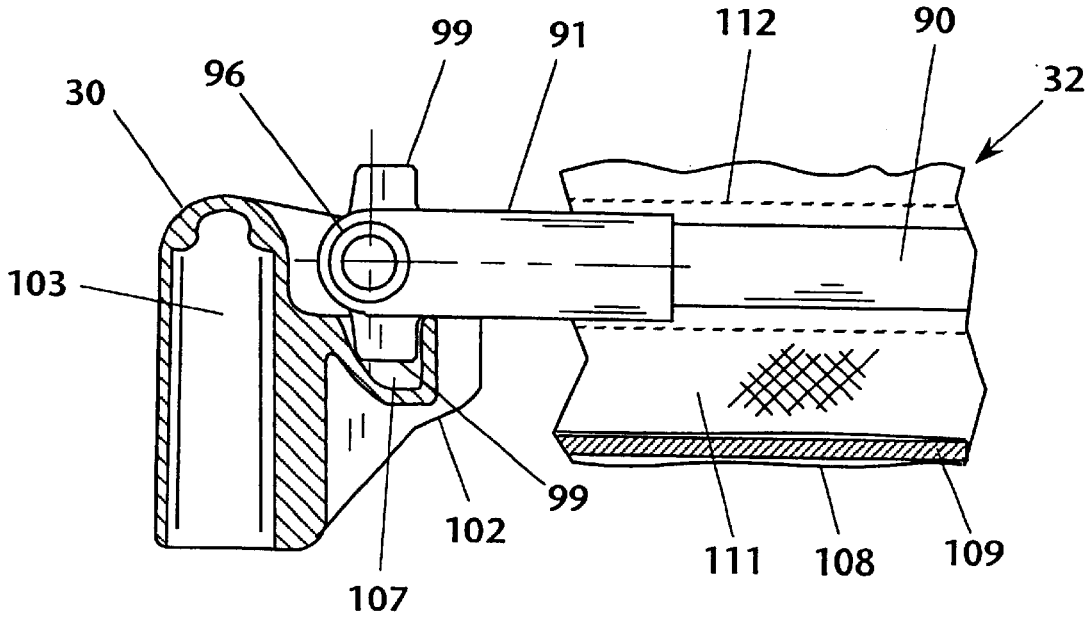
FIG. 7 is a cross-sectional elevation showing the engagement of the changing table frame assembly and the upper corner bracket assembly, taken along line 7—7 of FIG. 6.

With reference to FIGS. 6 and 7, each upper corner bracket 30 of the play pen 21 includes body portions 101 and 102 diverging from a common vertex in orthogonal relationship. Each body portion 101 and 102 includes sockets (not shown) for receiving and securing converging ends of the upper rail assemblies 36 and 37. In addition, a vertical receptacle 103 is provided to secure the upper end of a respective vertical strut 28.

A salient feature of the upper corner bracket 30 is the provision of a web 104 extending horizontally between the body portions 101 and 102 and disposed in the included angle therebetween. The web 104 includes a smoothly curved interior edge 106. A concave pocket 107 is formed in a medial portion of the web 104. The pocket is provided with a triangular configuration and is dimensioned to receive one of the triangular posts 99 of one of the elbow connectors 91. The connector 91 is adapted to rest on the web 104 in supported relationship, and the engagement of the post 99 in the pocket 107 firmly secures the elbow connector 91 with respect to the corner of the play pen 21. Thus the two corners of the changing table assembly 32 that are adjacent to two corners of the play pen are supported vertically and stabilized horizontally.

The changing table assembly 32 in FIG. 7 may be provided with a floor assembly 108 that includes a stiffening panel 109 secured within a fabric enclosure that is formed of waterproof or stain-resistant material, as is known in the prior art. Fabric panels 111 extend upwardly a short distance, and are provided with sewn sleeves 112 that extend about the lateral tubes 77 and 90, as well as about the assemblies 71. The panels 111 thus support the floor assembly 108 proximate to the upper extent of the play pen 21, whereby the changing table floor 108 is disposed at a height convenient for changing and dressing a baby or infant.

In the interests of manufacturing efficiency and simplicity in deployment of the apparatus, all of the upper corner brackets may be fashioned as depicted in FIG. 6, even though only two of the upper corner brackets are engaged by the changing table assembly at any one time. Likewise, the elbow connectors 47 of the bassinet assembly may be made identical to the elbow connectors 91 of the changing table assembly.

The side-by-side relationship of the bassinet assembly 31 and the changing table assembly 32 facilitates convenient changing and dressing of a baby before and after naps, as the changing surface is directly adjacent to the napping location. In addition, the bassinet is self-supporting atop the play pen structure, whereby it is easily installed or removed as needed. Likewise, the changing table assembly is easily installed or removed on demand, and is cooperatively supported by the play pen structure and the adjacent bassinet assembly.

The foregoing description of the preferred embodiment of the invention has been presented for purposes of illustration and description. It is not intended to be exhaustive or to limit the invention to the precise form disclosed, and many modifications and variations are possible in light of the above teaching without deviating from the spirit and the scope of the invention. The embodiment described is selected to best explain the principles of the invention and its practical application to thereby enable others skilled in the art to best utilize the invention in various embodiments and with various modifications as suited to the particular purpose contemplated. It is intended that the scope of the invention be defined by the claims appended hereto.

What is claimed is:

1. A play pen, bassinet assembly, and changing table assembly combination, comprising:

a play pen having an upper frame assembly;

a bassinet assembly removably supported on said upper frame assembly; and a changing table assembly removably supported on said upper frame assembly in side-by-side relationship to said bassinet assembly, said changing table assembly including a changing table surface locatable within a perimeter defined by said upper frame assembly.

2. The play pen, bassinet assembly, and changing table assembly combination of claim 1, wherein the changing table assembly includes a rectangular frame, and means for securing said changing table surface to span said rectangular frame.

3. The play pen, bassinet assembly, and changing table assembly combination of claim 2, wherein said upper frame assembly includes at least two adjacent corners, and at least one pair of upper corner brackets, each disposed at one of said adjacent corners.

4. The play pen, bassinet assembly, and changing table assembly combination of claim 3, wherein each upper corner bracket includes first and second bracket body portions extending from a common vertex in generally orthogonal relationship, and further including a web extending generally horizontally in the included angle between said first and second body portions.

5. The play pen, bassinet assembly, and changing table assembly combination of claim 4, wherein said rectangular frame includes a first pair of elbow connectors disposed at adjacent vertices of said rectangular frame, each of said first pair of elbow connectors disposed to impinge on a respective web of one of said upper corner brackets.

6. The play pen, bassinet assembly, and changing table assembly combination of claim 5, further including a pair of concave pockets, each formed in a respective web of said upper corner bracket.

7. The play pen, bassinet assembly, and changing table assembly combination of claim 5, further including at least one post extending from each of said first pair of elbow connectors, said post being configured to be received and retained in said concave pocket of said web.

8. The play pen, bassinet assembly, and changing table assembly combination of claim 7, wherein said post is provided with a triangular prism configuration, and said concave pocket is formed in complementary triangular recess fashion.

9. The play pen, bassinet assembly, and changing table assembly combination of claim 2, wherein said rectangular frame includes a pair of elbow connectors disposed at adjacent vertices of said rectangular frame, and further including means for releasably securing said pair of elbow connectors to said bassinet assembly.

10. The play pen, bassinet assembly, and changing table assembly combination of claim 9, wherein said bassinet assembly includes a pair of adapters, said adapters each disposed adjacent to said changing table assembly.

11. The play pen, bassinet assembly, and changing table assembly combination of claim 10, wherein said means for releasably securing said pair of elbow connectors includes a keyhole formed in each of said adapters, and a key extending from each of said pair of elbow connectors, said key configured to releasably engage said keyhole in supported relationship.

12. The play pen, bassinet assembly, and changing table assembly combination of claim 10, wherein said bassinet assembly includes hook portions disposed to extend over said upper frame assembly, and each of said adapters includes means for securing said hook portions.

13. The play pen, bassinet assembly, and changing table assembly combination of claim 12, wherein said upper frame assembly includes a pair of collapsible hinge joints, and each of said adapters includes means for engaging and retaining one of said collapsible hinge joints.

14. The play pen, bassinet assembly, and changing table assembly combination of claim 2, wherein said rectangular frame includes a pair of lateral tubes joined to a pair of tubular side assemblies.

15. The play pen, bassinet assembly, and changing table assembly combination of claim 14, wherein said means for securing said changing table surface includes a stiffening panel secured within a fabric enclosure, said fabric enclosure includes peripheral sleeves configured to receive therethrough said lateral tubes and said side assemblies.

16. The play pen, bassinet assembly, and changing table assembly combination of claim 14, further including means for selectively adjusting the length of said tubular side assemblies.

17. A play pen and bassinet assembly combination, comprising:

a play pen having first and second upper side rail assemblies in spaced apart disposition and a collapsible joint at a medial portion of each of said upper side rail assemblies; and a bassinet assembly adapted to be removably supported on said upper side rail assemblies, said bassinet assembly including:

a pair of bassinet frame assemblies including a first bassinet frame assembly adapted to be supported on said first upper side rail assembly and a second bassinet frame assembly adapted to be supported on said second upper side rail assembly, each of said bassinet frame assemblies being supportable on said respective collapsible joint; and a bassinet enclosure supported on said pair of bassinet frame assemblies.

18. A play pen comprising:

an upper frame assembly having a long axis;

a bassinet assembly removably supported on said upper frame assembly, said bassinet assembly having a long axis; and a changing table assembly removably supported on said upper frame assembly, said changing table assembly having a long axis, wherein the long axes of said bassinet assembly and said changing table assembly are perpendicular to the long axis of said upper frame assembly.

19. The play pen of claim 18, wherein the changing table assembly includes a rectangular frame, and means for securing a changing table surface to span said rectangular frame.

20. The play pen of claim 19, wherein said upper frame assembly includes at least two adjacent corners, and at least one pair of upper corner brackets, each disposed at one of said adjacent corners.

21. The play pen of claim 20, wherein each upper corner bracket includes first and second bracket body portions extending from a common vertex in a generally orthogonal relationship, and further including a web extending generally horizontally in the included angle between said first and second body portions.

22. The play pen of claim 21, wherein said rectangular frame includes a first pair of elbow connectors disposed at adjacent vertices of said rectangular frame, each of said first pair of elbow connectors disposed to impinge on a respective web of one of said upper corner brackets.

23. The play pen of claim 22, further including a pair of concave pockets, each formed in a respective web of said upper corner bracket.

24. The play pen of claim 23, further including at least one post extending from each of said first pair of elbow connectors, said post being configured to be received and retained in said concave pocket of said web.

25. The play pen of claim 24, wherein said post is provided with a triangular prism configuration, and said concave pocket is formed in complementary triangular recess fashion.

26. The play pen of claim 19, wherein said rectangular frame includes a pair of elbow connectors disposed at adjacent vertices of said rectangular frame, and further including means for releasably securing said pair of elbow connectors to said bassinet assembly.

27. The play pen of claim 26, wherein said bassinet assembly includes a pair of adapters, said adapters each disposed adjacent to said changing table assembly.

28. The play pen of claim 27, wherein said means for releasably securing said pair of elbow connectors includes a keyhole formed in each of said adapters, and a key extending from each of said pair of elbow connectors, said key configured to releasably engage said keyhole in supported relationship.

29. The play pen of claim 27, wherein said bassinet assembly includes hook portions disposed to extend over said upper frame assembly, and each of said adapters includes means for securing said hook portions.

30. The play pen of claim 29, wherein said upper frame assembly includes a pair of collapsible hinge joints, and each of said adapters includes means for engaging and retaining one of said collapsible hinge joints.

31. The play pen of claim 19, wherein said rectangular frame includes a pair of lateral tubes joined to a pair of tubular side assemblies.

32. The play pen of claim 31, wherein said means for securing a changing table surface includes a stiffening panel secured within a fabric enclosure, said fabric enclosure includes peripheral sleeves configured to receive therethrough said lateral tubes and said tubular side assemblies.

33. The play pen of claim 31, further including means for selectively adjusting the length of said tubular side assemblies.

34. A play pen, comprising:

an upper frame assembly;

a bassinet assembly configured to be removably supported on said upper frame assembly; and a changing table assembly configured to be removably supported on said upper frame assembly in side-by-side relationship to said bassinet assembly, said changing table assembly including a changing table surface locatable within a perimeter defined by said upper frame assembly.

35. In a play pen having an upper frame assembly, the improvement comprising:

a bassinet assembly removably supported on the upper frame assembly; and a changing table assembly removably supported on the upper frame assembly in side-by-side relationship to said bassinet assembly, said changing table assembly including a changing table surface locatable within a perimeter defined by the upper frame assembly.

* * * * *